US008328152B2

(12) United States Patent
Jeffery

(10) Patent No.: US 8,328,152 B2
(45) Date of Patent: Dec. 11, 2012

(54) COASTER

(75) Inventor: Doug R. Jeffery, San Diego, CA (US)

(73) Assignee: Axelgaard Manufacturing Co. Ltd., Fallbrook, CA (US)

( * ) Notice: Subject to any disclaimer, the term of this patent is extended or adjusted under 35 U.S.C. 154(b) by 575 days.

(21) Appl. No.: 12/489,317

(22) Filed: Jun. 22, 2009

(65) Prior Publication Data

US 2010/0320351 A1 Dec. 23, 2010

(51) Int. Cl.
*A47B 91/00* (2006.01)

(52) U.S. Cl. ..... 248/346.11; 215/393; 215/394; 220/737; 220/739; 62/457.4

(58) Field of Classification Search ..... 248/346.11; 215/394, 393; 220/737, 739; 62/457.4, 530
See application file for complete search history.

(56) References Cited

U.S. PATENT DOCUMENTS

| | | | | |
|---|---|---|---|---|
| 508,140 | A | | 11/1893 | Koch |
| 1,971,337 | A | | 8/1934 | Collins |
| 2,595,961 | A | | 12/1948 | Layne |
| 2,893,163 | A | | 5/1957 | Hazel |
| 4,089,498 | A | * | 5/1978 | Woodruff ..... 248/346.11 |
| 4,206,570 | A | | 6/1980 | Cooper |
| 4,433,823 | A | | 2/1984 | Pearson |
| 4,858,873 | A | | 8/1989 | Wilmoth et al. |
| 4,953,823 | A | | 9/1990 | Sheaffer et al. |
| 5,175,246 | A | * | 12/1992 | Smith et al. ..... 528/405 |
| 5,413,302 | A | * | 5/1995 | Ferster ..... 248/346.11 |
| 5,868,136 | A | | 2/1999 | Fox et al. |
| 6,038,464 | A | * | 3/2000 | Axelgaard et al. ..... 600/391 |
| 6,115,625 | A | | 9/2000 | Heard et al. |
| 6,263,226 | B1 | | 7/2001 | Axelgaard et al. |
| 6,619,608 | B1 | * | 9/2003 | Mulvey et al. ..... 248/346.11 |
| 6,964,401 | B1 | | 11/2005 | Kelley et al. |
| 7,331,194 | B2 | * | 2/2008 | Lefkowitz et al. ..... 62/457.4 |
| 2006/0059944 | A1 | * | 3/2006 | Taylor et al. ..... 62/457.4 |
| 2008/0272261 | A1 | * | 11/2008 | Morlan ..... 248/346.11 |
| 2009/0020676 | A1 | * | 1/2009 | Curry ..... 248/346.11 |

* cited by examiner

*Primary Examiner* — Ramon Ramirez
*Assistant Examiner* — Todd M Epps
(74) *Attorney, Agent, or Firm* — Walter A. Hackler

(57) ABSTRACT

A coaster or trivet includes a liquid impervious base and a liquid absorbent gel disposed on the base. The gel may comprise a hydrogel including a plurality of gel layers. Each gel layer is a different adhesive property with a first gel layer having a relatively high peel strength for contacting the base and a second gel layer having a relatively low peel strength for removably contacting a container.

11 Claims, 2 Drawing Sheets

FIG. 3.
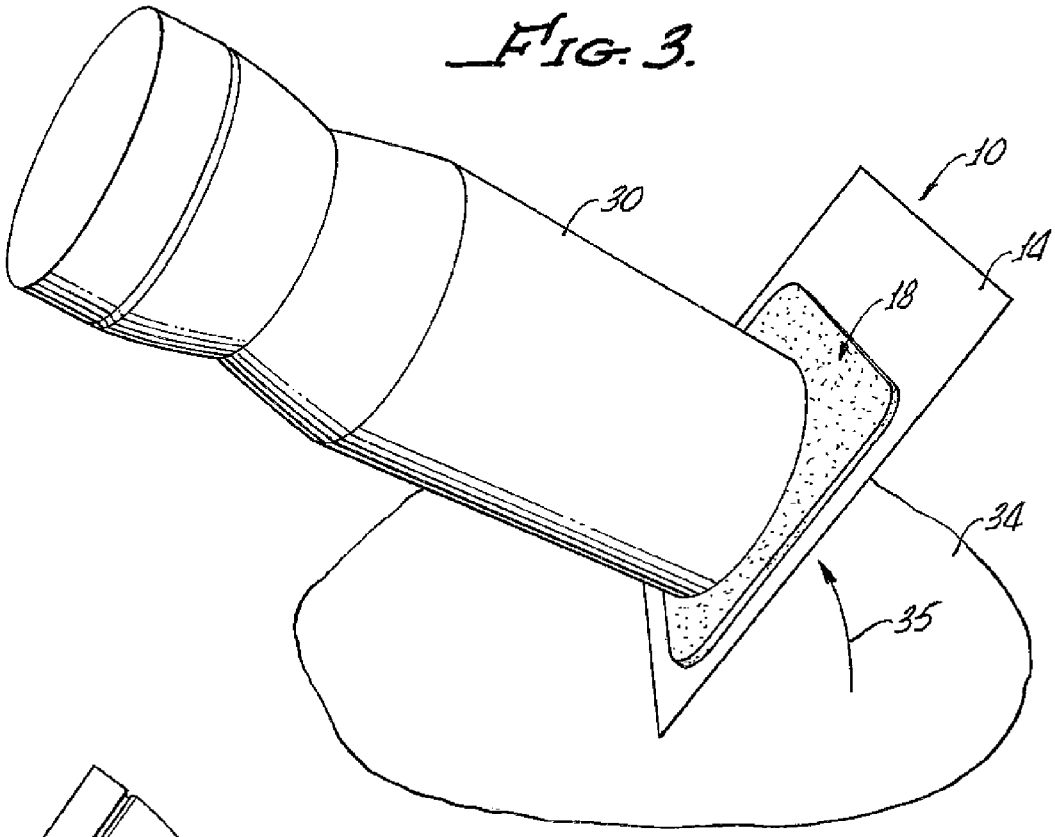
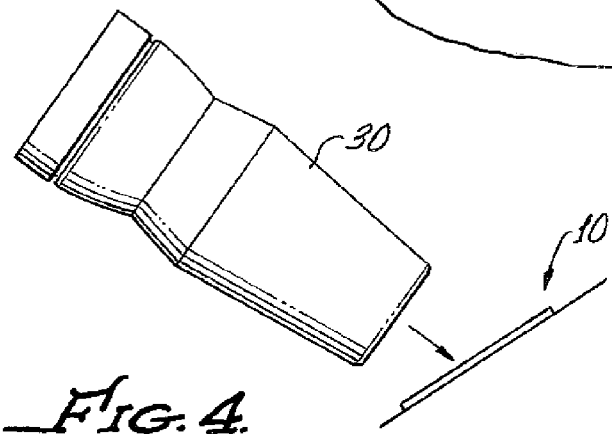
FIG. 4.
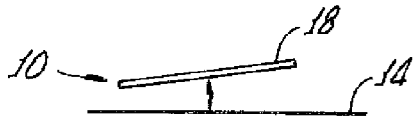
FIG. 5.
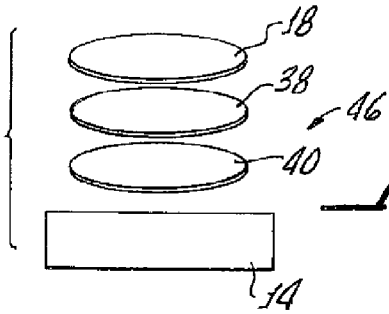
FIG. 6.

COASTER

The present invention generally relates to coasters and trivets for the protection of furniture from moisture and/or heat due to vessels disposed thereon and is more particularly directed to a coaster for preventing condensation forming on surfaces of the vessel from reaching the furniture or the like while at the same time maintaining removable adherence of the coaster to the vessel.

It is well known that glasses and containers having cold beverages therein collect condensation which either runs onto furniture or alternatively, drips from the container onto the clothes of a person elevating the container from a surface. Hot containers also have been known to damage supporting surfaces.

In addition, coasters for the support of plant pots or moist objects are necessary for preventing moisture from damaging furniture and flooring or carpeting.

Conventional drink coasters typically use materials of sponge, cork, plastic, or fabric materials for receiving and collecting condensate from a container. Unfortunately, such materials eventually become wet and temporarily bond to the container.

This temporary bond is most often broken as the container is raised whereupon the coaster drops onto the table or the drinker creating an unwanted mess.

The present invention overcomes the problems of the prior art by providing a coaster/trivet which adheres to the container while at the same time absorbing moisture therefrom.

SUMMARY OF THE INVENTION

A coaster/trivet in accordance with the present invention generally includes a liquid impervious base along with a liquid absorbent and or liquid repellent gel, preferably disposed on the base with the gel including a single or a plurality of gel layers, with a top and bottom layer. When a plurality of gel layers are utilized, each gel layer has different adhesive property. For example, a bottom gel layer has a relatively high peel strength for contacting the base and the top gel layer has a relatively lower peel strength for removably contacting a container.

In one embodiment, the gel is heat resistant to enable trivet, or heat protection, use of the base.

More particularly, the coaster in accordance with the present invention includes two layers of gel, where the top gel layer with relatively low peel strength of sufficient adherence to enable the base to maintain contact with the container upon elevation of the container from a supporting surface. This structure thus prevents separation of the coaster from the container when lifted as is the case with any prior art coasters.

The relatively high peel strength of the bottom gel layer is sufficient to enable separation of the base from the container, when desired, with the gel layers adhered thereto. This facilitates a replacement of the gel coaster on the base as may be desired after extended use of the coaster.

To enhance absorption of condensate on the container, the coaster in accordance with the present invention may further include an absorbent material like a sponge or super absorbent polymer like material, which could be disposed between gel layers or contained or surrounded by the gel layers. Preferably, the top gel layer is permeable to water for enabling water absorption into the sponge layer therethrough.

In addition, the coaster may have greater dimensions than an item placed thereon which is effective for stabilizing the item on a supporting surface. The greater dimension also provide for a greater area available for indicia to be present thereon for either trademark or promotion/advertising use.

A coaster kit in accordance with the present invention includes a liquid impervious base along with a plurality of liquid absorbent gels, as hereinabove described. Each of the gels are disposable on the base, thus enabling the reuse of the base, or the base material itself can be disposable along with the gel.

BRIEF DESCRIPTION OF THE DRAWINGS

The advantages and features of the present invention will be better understood by the following description when considered in conjunction with the accompanying drawings in which:

FIG. 3 is a perspective view similar to FIG. 1 illustrating elevation of the container with the coaster attached thereto;

FIG. 4 is an illustration showing separation of the coaster from the container with the gel adhered to the base;

FIG. 5 is an illustration showing separation of the gel from the base; and

FIG. 6 is an illustration of a kit in accordance with the present invention showing a base with multiple gel layers.

DETAILED DESCRIPTION OF THE INVENTION

Figure 1:
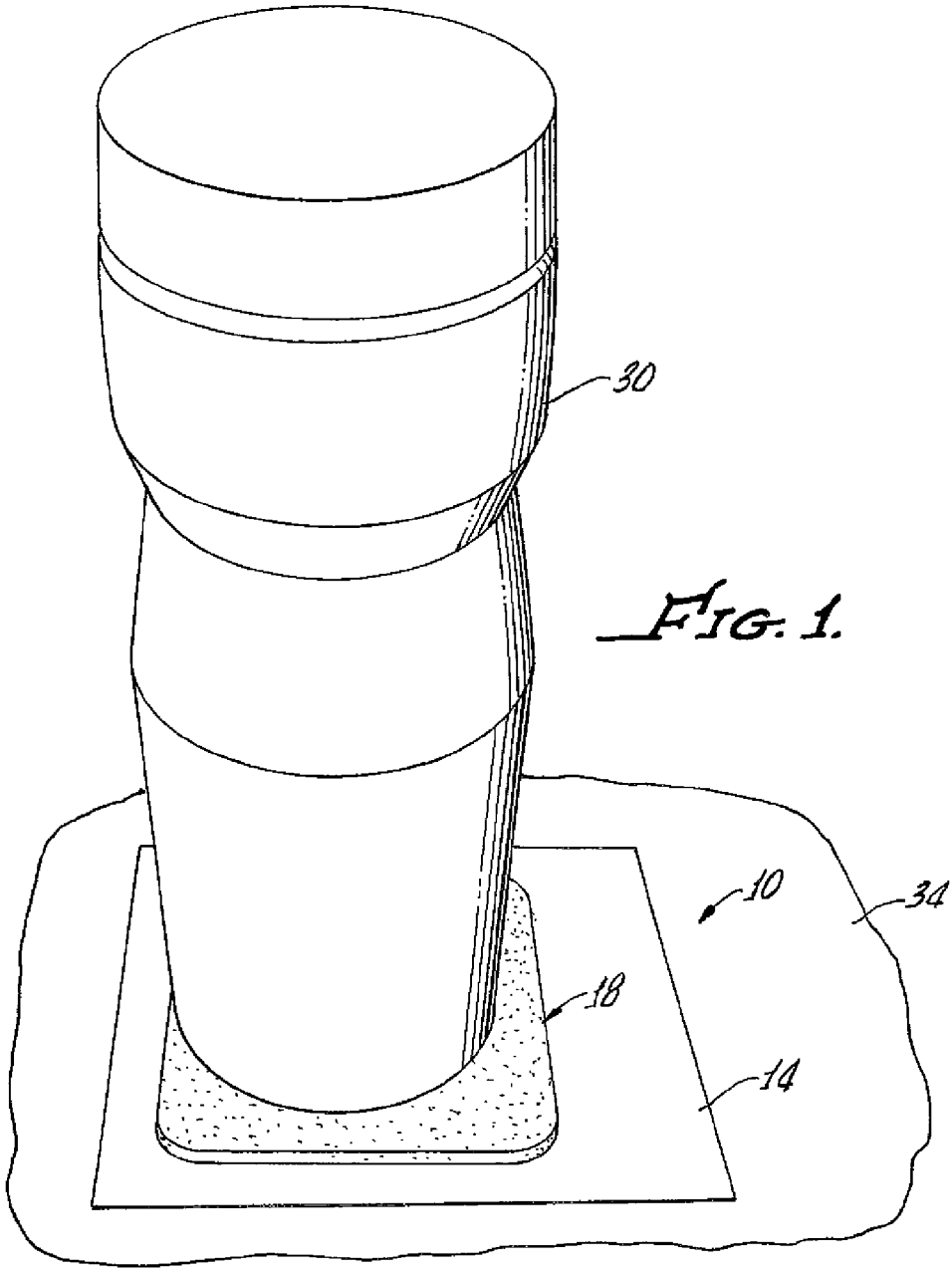
FIG. 1 is a perspective view of a coaster in accordance with the present invention generally showing a base, a liquid absorbent gel and a container disposed thereon.
Figure 2:
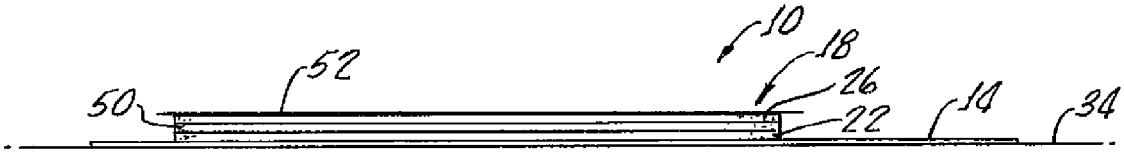
FIG. 2 is a cross sectional view of the coaster shown in FIG. 1 showing the gel being comprised of multiple layers.

With reference to FIG. 1, there is shown a coaster 10 which generally includes a liquid impervious base 14 and a liquid absorbent gel 18 disposed on the base 14. As shown in FIG. 2, the gel 18 may include a single gel layer or a plurality of gel layers 22, 26 each having a different adhesive property. A larger dimension of the gel and/or base 14 also provides stabilization of a container 30 on a supporting surface. The gel 18 may also be heat resistant for effectively enabling the base 14 and gel 18 to be used as a trivet or the like for hot objects. Such gels may be hydrogels similar to but not limited to silica gels, aerogels, acrylate hydrogels, hydocolloids, or alkyl-based hydrogels.

Indicia, not shown, also may be provided on the base 14 as hereinabove noted for trademark, advertisement, or for promotional use. Further, colorant can be added to the gel(s) and made to represent trademarks, advertisements, or for promotional use.

The first gel layer 22 has a relatively high peel strength for contacting the base 14 and a second gel layer 26 has a relatively low peel strength for removably contacting a container 30, see FIG. 1. While a drink container 30 is illustrated, the present invention is not limited thereto. The coaster is suitable for supporting any object (not shown) which may cause damage to a surface through moisture or by contact. Such objects include, for example, liquid hand soap dispensers and planters.

As illustrated in FIG. 3, the relatively low peel strength of the second gel layer 26 is sufficient to enable the coaster 10 to maintain adherence to the container 30 upon elevation of the container 30 from a supporting surface 34 as indicated by arrow 35. Further, the second gel layer 26 absorbs water from the container 30 which is later released back into the air over a period of time.

The relatively high peel strength of the first gel layer 22 is sufficient to enable separation of the base 14 from the container 30 with the gel 18 adhered thereto as shown in FIG. 4.

This facilitates removal of the gel 18 from the base 14 if necessary to replace the gel 18 with a replacement gel 38, 40, see FIGS. 5 and 6.

Thus, the present invention also encompasses a drink coaster kit 46 which may include a base 14 and a plurality of replacement gels 18, 22, 26, 38, 40.

With reference again to FIG. 2, the coaster 10 in accordance with the present invention may include a sponge layer 50 disposed between the first gel layer 22 and the second gel layer 26 absorbing condensation from the container 30 through the second gel layer 26, which is permeable to water for enabling water absorption by the sponge layer 50 therethrough.

A removable sheet 52 may be provided for preventing inadvertent adhesion to the second gel layer prior to use.

While the coaster 10, in accordance with the present invention is illustrated having a specific shape, it should be understood that the present invention is not limited to the shape of the coaster 10 and could certainly be of any shape including shapes such as round, square, rectangular, hexagon, octagon, or an irregular shape.

The shape of the coaster 10 has no effect upon its ability to function and is in no way important to the invention. Nor should the indicated thickness of all layers in FIGS. 1, 2, 3, 4, 5, and 6 be indicative of the limits of the invention.

Base 14 may be formed from any suitable plastic-type material and suitable gel layers 18, 22, 38, 40 as well as the sponge layer 15 may be any suitable polymers such as, for example, set forth in U.S. Pat. Nos. 5,868,136, 6,038,464 6,115,625, 6,263,226, or 7,540,979. These referenced patents are to be incorporated herein in their entirety for illustrating suitable gel and hydrogel layers 18, 22, 26, 38, 40 and sponge layer 50.

Although there has been hereinabove described a specific drink coaster in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A drink coaster comprising:

a liquid impervious base; and a liquid absorbent gel, or hydrogel, disposed on the base, the gel including a plurality of gel layers, each gel layer having a different adhesive property, a bottom gel layer having a relating high peel strength for contacting the base and a top gel layer having a relatively low peel strength for removably contacting a container.

2. A coaster according to claim 1 wherein the relatively low peel strength of a top gel layer is sufficient to enable the base to maintain adherence to said container upon elevation of said container from a supporting surface.

3. The coaster according to claim 1 wherein the relatively high peel strength of the bottom gel layer is sufficient to enable separation of the container from the base with the gel remaining adhered thereto.

4. A drink coaster kit comprising:

a liquid impervious base; and a plurality of liquid absorbent gels, each disposable on the base, each gel including a plurality of gel layers, each gel layer having a different adhesive property, a bottom gel layer having a relatively high peel strength for contacting the base and a top gel layer having a relatively low peel strength for removably contacting a container.

5. The coaster kit according to claim 4 wherein the relatively low peel strength of each top gel layer is sufficient to enable the base to maintain adherence to said container upon elevation of said container from a supporting surface.

6. The coaster kit according to claim 4 wherein the relatively high peel strength of each bottom gel layer is sufficient to enable separation of the container from the base with the gel remaining adhered thereto.

7. The coaster kit according to claim 4 further comprises an absorbent material layer laminated between the top and bottom gel layers.

8. The coaster kit according to claim 7 wherein the top layer is permeable to water for enabling water absorption into the absorbent material laminated between the top gel layer and a corresponding bottom layer.

9. The coaster kit according to claim 8 wherein the relatively low peel strength of each top gel layer is sufficient to enable the base to maintain adherence to said container upon elevation of said container from a supporting surface.

10. The coaster kit according to claim 8 wherein the relatively high peel strength of each bottom gel layer is sufficient to enable separation of the container from the base with the gel remaining adhered thereto.

11. The coaster kit according to claim 10 wherein the relatively high peel strength of each bottom gel layer is sufficient to enable separation of the base from the container with the gel adhered thereto.

* * * * *